US006628907B2

(12) United States Patent
Dinca et al.

(10) Patent No.: US 6,628,907 B2
(45) Date of Patent: Sep. 30, 2003

(54) TONER DUSTING SENSOR AND METHOD

(75) Inventors: Laurian Dinca, Eagle, ID (US); Ioana Monica Dinca, Eagle, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 4 days.

(21) Appl. No.: 10/004,890

(22) Filed: Dec. 7, 2001

(65) Prior Publication Data

US 2003/0108357 A1 Jun. 12, 2003

(51) Int. Cl.[7] ..... G03G 21/00
(52) U.S. Cl. ..... 399/98
(58) Field of Search ..... 399/81, 98, 99

(56) References Cited

U.S. PATENT DOCUMENTS 5,960,228 A * 9/1999 Budnik et al. ..... 399/81 X
6,157,791 A 12/2000 Haines et al. ..... 399/23

FOREIGN PATENT DOCUMENTS

JP 57-040270 * 3/1982

* cited by examiner

*Primary Examiner*—William J. Royer

(57) ABSTRACT

An electrophotographic imaging device includes a sensor for detecting uncontained toner. When the uncontained toner reaches a predetermined threshold, a warning signal can be generated indicating that a cleaning of the printer is recommended. With the present invention, potential print defects and/or mechanical jams may be reduced by avoiding excess accumulation of uncontained toner in the imaging device.

20 Claims, 3 Drawing Sheets

TONER DUSTING SENSOR AND METHOD

FIELD OF THE INVENTION

The invention relates to the electrophotographic imaging arts. It finds particular application to a method and system of detecting toner dust in an electrophotographic imaging device. It will be appreciated that the present invention will find application in printers, copiers, fax or other imaging devices where toner may cause undesired effects or malfunctions.

BACKGROUND OF THE INVENTION

In an electrophotographic printer, during an image transfer process between a photosensitive drum and a transfer roller, toner dust particles can migrate from the photosensitive drum, the transfer roller, or from print media into a post transfer area of the printer. These toner dust particles can stick to the leading edge of a page and be carried to a fuser where they can lead to fuser contamination or separation claw contamination. Toner deposits in the fuser can produce fuser contamination effects (e.g. unwanted toner particles on printed media) or mechanical jams.

Typically, an electrophotographic printer also includes a toner waste hopper to collect excess toner from the photosensitive drum. Seals are typically used to contact the surface of the photosensitive drum and are intended to prevent toner stored in the waste hopper from leaking out into the printer. Occasionally, toner leaks from the waste hopper and gets distributed within the interior of the printer, particularly along the path followed by the print media. Leaks may occur due to, for example, an overfilled waste hopper or broken seals.

Toner dust that leaks from the waste hopper or otherwise comes from the image transfer process, tends to move and accumulate in an area near the fuser and transfer roller. Often, the toner dust may attach to the back side of successive print media passing over the transfer roller resulting in a print defect. Fusers are particularly susceptible to contamination from toner dust. Additionally, toner dust can migrate throughout the printer potentially contaminating other components and assemblies causing undesirable print defects and possibly operational defects and component damage.

SUMMARY OF THE INVENTION

In accordance with one embodiment of the present invention, an apparatus for detecting toner particles in an electrophotographic imaging device is provided. The apparatus includes a sensor positioned within the imaging device to detect uncontained toner particles. A controller is coupled to the sensor and generates a warning signal when the uncontained toner particles reach a predetermined level.

In accordance with another embodiment of the present invention, a method of detecting toner dust in an electrophotographic imaging device is provided. The method includes moving one or more print media along a printing path within the electrophotographic imaging device. Toner is transferred to the print media at a transfer point along the printing path. An accumulation of toner dust is detected subsequent to the transfer point and a warning signal is generated when the accumulation of toner dust meets a predetermined condition.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to provide examples of the principles of this invention.

DETAILED DESCRIPTION OF ILLUSTRATED EMBODIMENT

The following includes definitions of exemplary terms used throughout the disclosure. Both singular and plural forms of all terms fall within each meaning:

"Signal", as used herein, includes but is not limited to one or more electrical signals, one or more computer instructions, a bit or bit stream, or the like.

"Software", as used herein, includes but is not limited to one or more computer executable instructions, routines, algorithms, modules or programs including separate applications or code from dynamically linked libraries for performing functions and actions as described herein. Software may also be implemented in various forms such as a stand-alone program, a servlet, an applet, code stored in a memory, or other type of executable instructions.

"Logic", as used herein, includes but is not limited to hardware, firmware, software and/or combinations of both to perform a function(s) or an action(s). Logic also includes a software controlled microprocessor or discrete logic such as an application specific integrated circuit (ASIC). It will be appreciated that logic may be fully embodied as software or by functionally equivalent circuits and vise versa.

Figure 1:
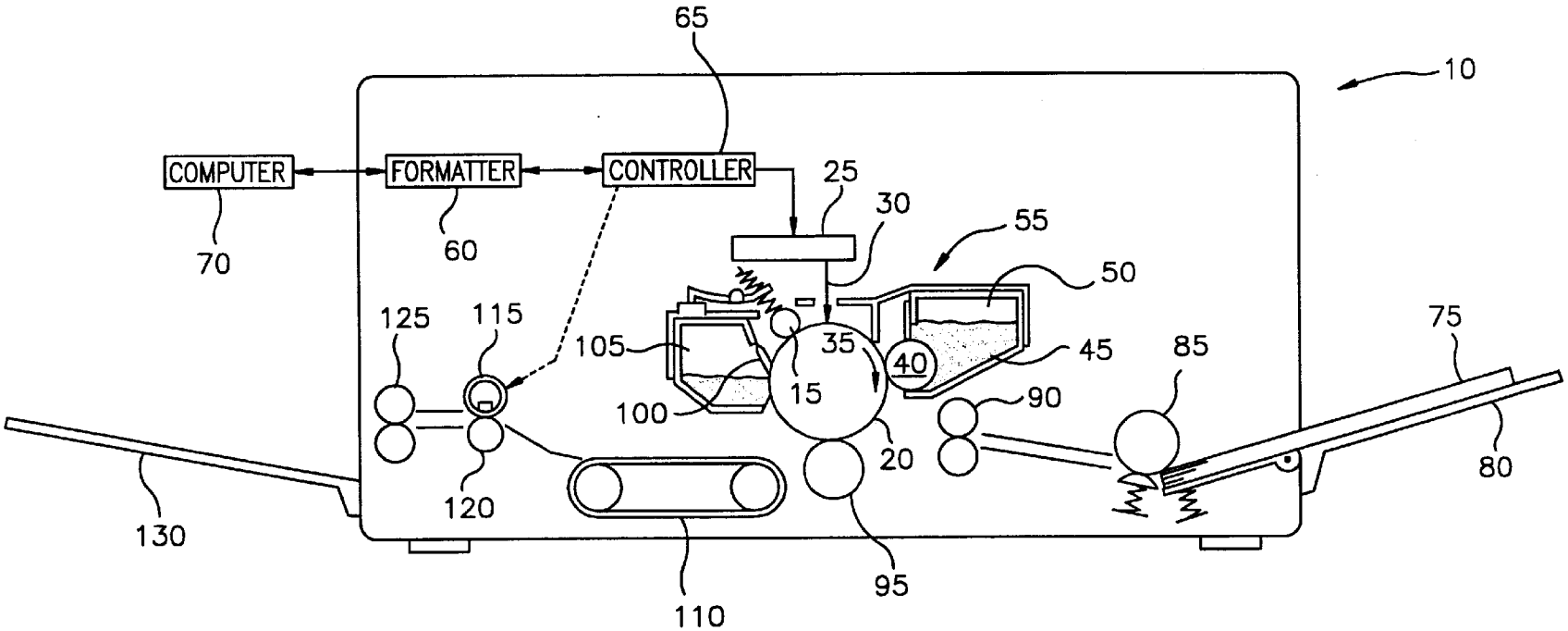
FIG. 1 is an exemplary cross-section view of an electrophotographic printer.

Illustrated in FIG. 1 is a simplified cross sectional view of an embodiment of an exemplary electrophotographic imaging device such as an electrophotographic printer 10. The printer 10 includes, for example, a charge roller 15 that charges the surface of a photoconductor, such as an organic photoconductor drum 20, to a predetermined voltage. A laser scanner 25 includes a laser diode (not shown) that emits a laser beam 30 onto the photoconductor drum 20 to selectively discharge its surface. The laser beam 30 is reflected off a multifaceted spinning mirror (not shown) that reflects or "scans" the laser beam 30 across the surface of the photoconductor drum 20 forming a latent electrostatic image corresponding to the data being printed. The photoconductor drum 20 rotates in a clockwise direction as shown by the arrow 35 such that each successive scan of the laser beam 30 is recorded on the photoconductor drum 20 after the previous scan.

To this end, the embodiment of the electrophotographic imaging device shown in FIG. 1 includes a software configured processing device, such as formatter 60 and controller 65. Alternatively, the electrophotographic printer 10 could use other processing devices such as a microprocessor, discrete logic or other digital state machines. To form the latent electrostatic image, the formatter 60 receives data, including print data (such as, a display list, vector graphics, or raster print data) from an application program running on a computer 70. The formatter 60 converts the print data into a stream of binary print data that is an electronic representation of each page to be printed, and sends it to the controller 65. The controller 65 supplies the stream of binary print data to the laser scanner 25 causing the laser diode to pulse in accordance with the data, thus creating the latent electrostatic image on photoconductor drum 20. In addition, the formatter 60 and controller 65 exchange data necessary for controlling the electrophotographic printing process as known in the art for a particular imaging device.

With further reference to FIG. 1, after the surface voltage of the photoconductor drum 20 has been selectively discharged, a developing device, such as a developing roller 40, transfers toner to the surface of the photoconductor drum 20. Toner 45, for example, is stored in a toner reservoir 50 of a toner print cartridge 55. A magnet (not shown) located within the developing roller 40 magnetically attracts the toner 45 to the surface of the developing roller 40. As the developing roller 40 rotates, the toner is electrostatically transferred from the developing roller 40 to the discharged surface areas on the photoconductor drum 20 thus covering the latent electrostatic image with toner particles.

A print media 75, such as paper, envelopes, transparencies, and the like, is loaded from a media tray 80 by a pickup roller 85 and travels in a printing path in the electrophotographic printer 10. The print media 75 moves through drive rollers 90 so that the arrival of the leading edge of the print media 75 at a transfer point below the photoconductor drum 20 is synchronized with the rotation of the latent electrostatic image on the photoconductor drum 20. There, a transfer device, such as a transfer roller 95, charges the print media 75 so that it attracts the toner particles away from the surface of the photoconductor drum 20. As the photoconductor drum 20 rotates, the toner adhered to the discharged areas contacts the charged print media 75 and is transferred thereto.

The transfer of toner particles from the photoconductor drum 20 to the surface of the print media 75 is not always complete and some toner particles may remain on the photoconductor drum 20. To clean the photoconductor drum 20, a cleaning blade 100 may be included to remove non-transferred toner particles as the photoconductor drum 20 continues to rotate and the toner particles are deposited in a toner waste hopper 105. The photoconductor drum 20 may then be completely discharged by discharge lamps (not shown) before a uniform charge is restored to the photoconductor drum 20 by the charge roller 15 in preparation for the next toner transfer.

As the print media 75 moves in the printing path past the photoconductor drum 20 and the transfer roller 95, it enters a post transfer area. There, a conveyer 110 delivers the print media 75 to a fixing device, such as a heated fuser roller 115 and a heated pressure roller 120, generally referred to herein as a fuser. The rollers 115 and 120 are in pressure engagement with each other and form a nip at the contact point. As the print media 75 passes between the rollers 115 and 120 through the nip, the toner is fused to the print media 75 through a process of heat and pressure. One or both rollers 115 and 120 are motor driven to advance the print media 75 between them. The fuser roller 115 is, for example, constructed with a hollow metal core and an outer layer often made of a hard "release" material such as a Teflon® film. A heating device, such as a ceramic heating strip is positioned inside the core along the length of the fuser roller 115. The heating strip can be silver based with a glass cover to reduce friction with the fuser roller 115. Other heating devices may include a quartz lamp, heating wires or other suitable heating elements as known in the art. The pressure roller 120 is, for example, constructed with a metal core and a pliable outer layer. The pressure roller 120 may also include a thin Teflon® release layer (not shown). After fusing the toner to the print media 75, output rollers 125 push the print media 75 into an output tray 130 and printing is complete.

With continued reference to FIG. 1, the controller 65 also controls a high voltage power supply (not shown) to supply voltages and currents to components used in the electrophotographic processes, such as to the charge roller 15, the developing roller 40, and the transfer roller 95. Furthermore, controller 65 controls a drive motor (not shown) that provides power to a gear train (not shown) and controls various clutches and paper feed rollers necessary to move the print media 75 through the printing path within the electrophotographic printer 10. These components are known in the art. It will be appreciated that different imaging devices may have components and control mechanisms different than those shown in the exemplary system of FIG. 1. One of ordinary skill will appreciate that the present invention will apply to other devices in accordance with their particular configuration and obvious modifications thereto.

Figure 2:
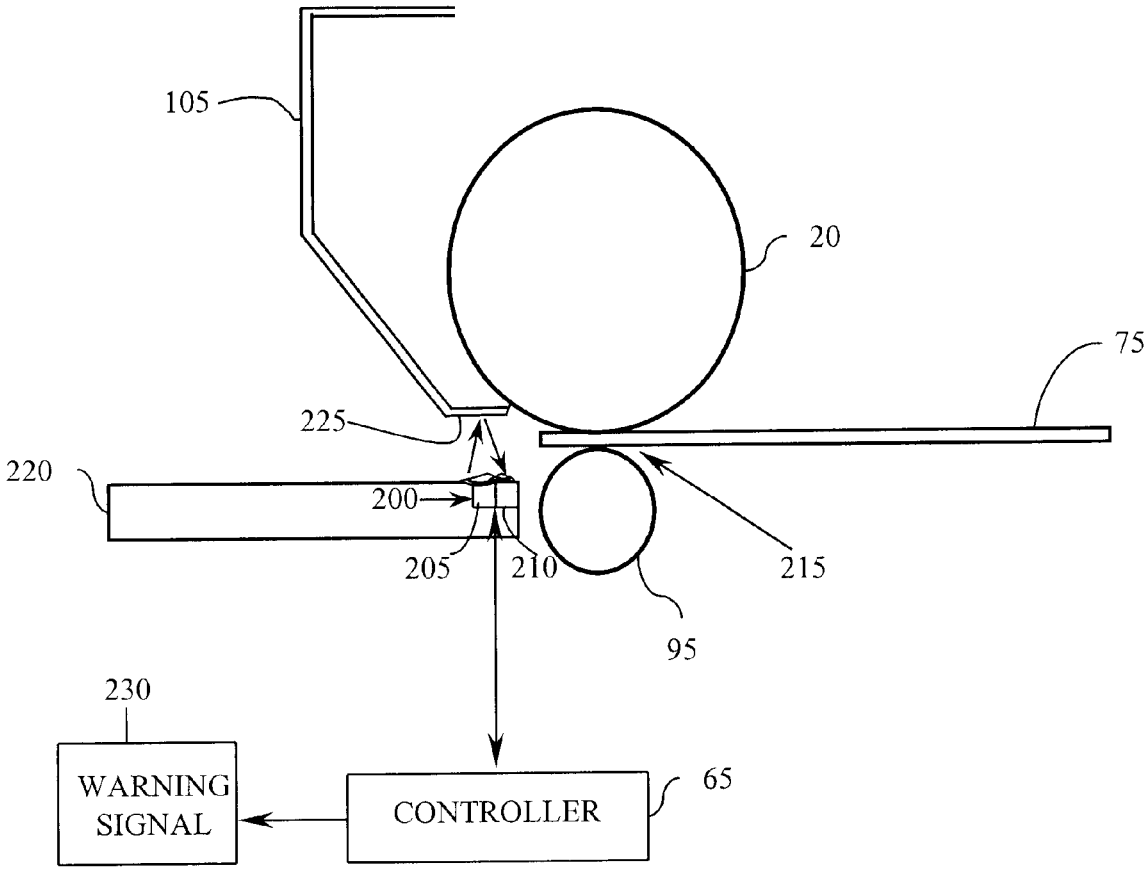
FIG. 2 is a partial view of FIG. 1 showing an exemplary toner dust sensor in accordance with one embodiment of the present invention.

Illustrated in FIG. 2 is a partial view of the printer 10 shown in FIG. 1 and one embodiment of a toner dust sensor 200 that detects accumulation of toner particles in the printer 10 in accordance with the present invention. In this embodiment, the sensor includes a light emitting diode (LED) 205 and a photosensor 210. The sensor 200 is positioned in a post transfer area of the printer 10. In general, the post transfer area is an area beyond a transfer point 215 which is where toner is transferred from the photoconductor drum 20 to the print media 75. As shown in FIG. 2, the sensor 200 is mounted on a plate 220 that directs the print media 75 towards the conveyor 110. The sensor 200 is positioned closely adjacent the transfer point 215. Of course, it will be appreciated that some printers may not have a plate 220 in which case the sensor 200 is positioned in another suitable location or on another component in the post transfer area.

By positioning the toner dust sensor 200 close to the transfer point 215, the sensor 200 will sense accumulation of toner dust. Toner dust includes excess or non-transferred toner particles that are uncontained within the printer 10 and accumulate in locations where they should not be found. Toner dust may fall from the photoconductor drum 20, be pushed off the photoconductor drum 20 by the print media 75, leak from the toner wasted hopper 105, leak from the toner print cartridge 55 and the like. The toner dust may get distributed on the interior of the printer 10, particularly along the printing path followed by print media 75. The toner dust can adhere to the print media 75 in unintended locations and may result in print defects or even printer malfunctions.

With further reference to FIG. 2, one embodiment of the invention includes having the light emitting diode 205 and the photosensor 210 oriented in a non-facing configuration. To detect the accumulation of toner dust on the sensor 200, the light emitting diode 205 emits light (shown by the arrows) towards a reflector 225 that reflects the light towards the photosensor 210. The reflector 225 is a mirror or other light reflective surface mounted to the toner waste hopper 105 or other printer component as desired. The photosensor 210 includes a photosensor circuit (not shown) that generates a status signal representing an amount/intensity of light detected. For example, the status signal is a voltage. When toner dust accumulates on the sensor 200, the intensity of light detected by the photosensor 210 will be reduced causing the voltage generated by the photo-sensor circuit to decrease. In a configuration where the toner dust sensor 200 is positioned close to the photoconductor drum 20, it may be desirable to include a baffle or other light blocking element such that the light emitted from the light emitting diode 205 does not affect the light sensitive photoconductor drum 20. The status signal may also be generated if a sufficient amount of toner is between or in the vicinity of the components of the sensor 200 such as drifting, falling and/or air born toner. Thus, accumulation also includes toner that is not directly on the sensor 200.

The status signal is checked by the controller 65 at selected times which is described below. The controller 65 includes logic that compares the status signal to a predetermined warning threshold value. If the warning threshold value is reached and/or passed, e.g. the voltage drops below the threshold value, the controller 65 generates a warning signal 230 that is visually displayed on the printer's display, e.g. a light signal, and/or emits an audible sound. The warning signal 230 indicates to a user that toner dust has accumulated and a cleaning is recommended. Cleaning the printer 10 may increase the overall performance of the printer 10, reduce toner dust from reaching the fuser roller 115, and may avoid potential malfunctions.

Figure 3:
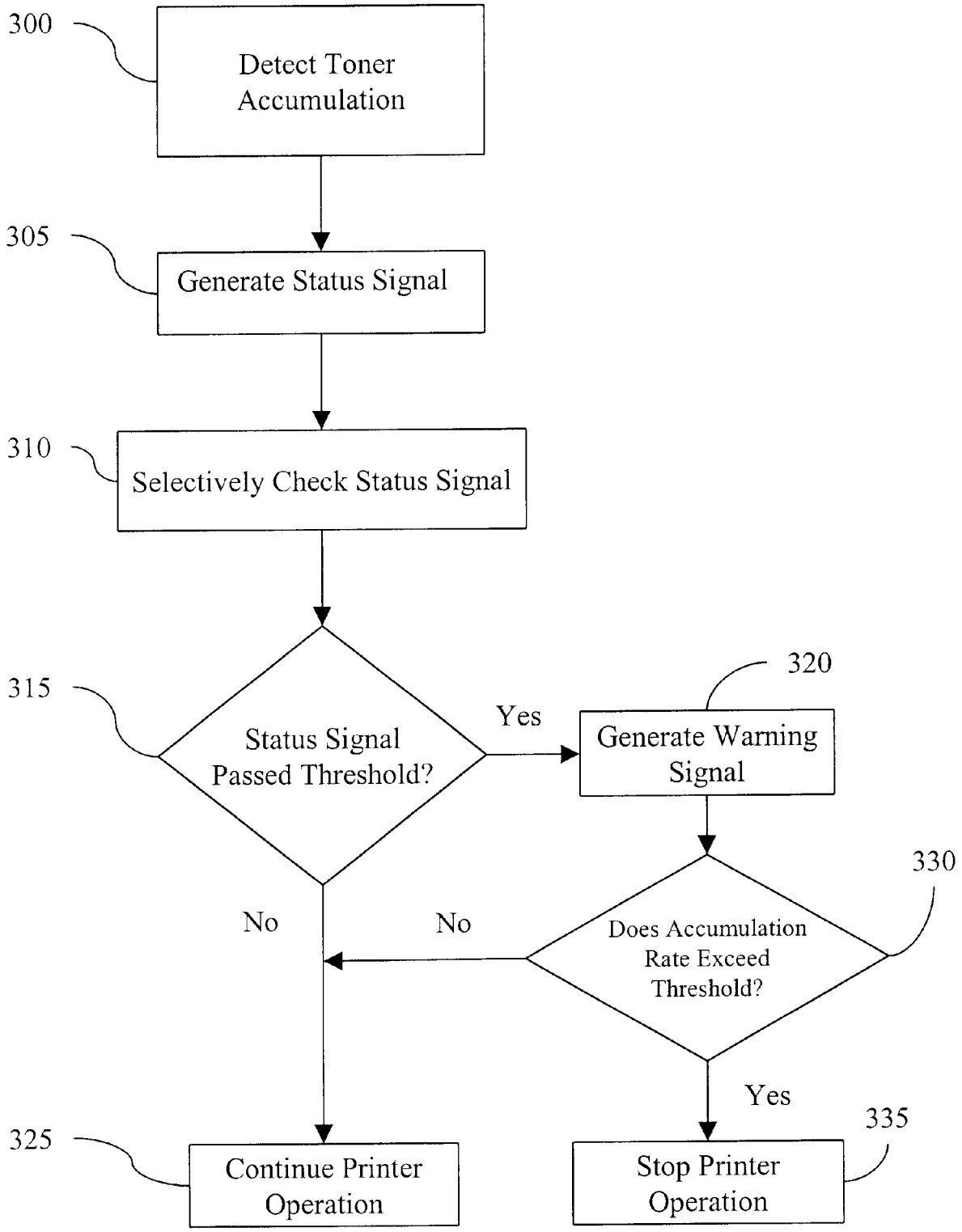
FIG. 3 is an exemplary methodology of detecting toner dust in accordance with one embodiment of the present invention.

Illustrated in FIG. 3 is an exemplary methodology for detecting toner dust in accordance with the present invention. The blocks shown represent functions, actions or events performed therein. It will be appreciated that the illustrated blocks can be performed in other sequences different than the one shown.

With reference to FIG. 3, toner dust is detected by the toner dust sensor 200 in the post transfer area (block 300). The toner dust sensor 200 generates a status signal that represents detected toner dust (block 305). In the above embodiment, the photo-sensor 210 generates a voltage based on the intensity of light detected from the light emitting diode 205. As toner accumulates on the toner dust sensor 200 or otherwise is between the light emitting diode 205 and photosensor 210, thus obstructing the detection of light, the intensity of light detected will decrease which in turn decreases the generated voltage. In one embodiment, the light emitting diode 205 continuously emits light to detect toner, or alternatively, it is activated upon a request to detect toner, for example, from the controller 65. When the status signal from the toner dust sensor 200 is present, it is checked at selective times (block 310) to determine whether the status signal has reached and/or passed a predetermined warning threshold value (block 315). In the above embodiment, when the voltage generated by the photosensor 210 drops below a predetermined threshold voltage, a warning signal 230 is generated (block 320). In general, it is determined whether the detected uncontained toner has met a predetermined condition that causes the warning signal 230 to be generated. The warning signal 230 can be a visual signal, an audible signal, a textual message or any combination of these. If the threshold value is not passed, indicating that the amount of toner dust is still at an acceptable level, the printer operation is continued (block 325).

Optionally, the controller 65 may be additionally programmed with logic to monitor the rate of toner accumulation. For example, if there is a sudden defect in the waste hopper seal, then the amount of toner accumulating on the toner dust sensor 200 could increase very fast. In this case, the controller 65 would initiate a stop engine instruction stopping the operation of the imaging device to limit the impact of the defect. As seen in FIG. 3, the system checks whether the rate of accumulation meets and/or exceeds a stop engine threshold (block 330). If so, operation of the device is stopped (block 335) and a special warning signal can be generated. It will be appreciated that the accumulation rate check can be performed separate from the regular accumulation check, at different times, or both together.

In this embodiment, two thresholds are set. First is the warning threshold that generates a warning message but the imaging device is still allowed to operate. The second is the stop engine threshold if the amount of toner accumulated or the rate of accumulation is excessive, in which case, operation is stopped. This is determined from the sensor 200 by measuring an increased rate of signal reduction. In one embodiment, the values measured from the status signal are stored along with an associated time of measurement. The values can then be compared to each other over a selected time to determine if the rate of toner accumulation is excessive. Of course, one skilled in the art will appreciate that there are other ways to determine the rate of accumulation.

Regarding the timing of checking the status signal from the sensor 200 it may be checked during non-printing modes or printing modes. Non-printing modes include, for example, during power-up of the printer 10 during initialization, during power-save mode, during a stand-by mode when the printer 10 is waiting for a print job, or other times when printing is not being performed. During a printing mode, the status signal is checked before a print job begins, after a print job ends, or during a print job. If a print job is large (e.g. many printed pages), it may be desirable to check for toner dust during the print job. However, if the sensor 200 is positioned such that print media 75 blocks the emitted light while it passes through the printing path, synchronization with the print media 75 is necessary so that the status signal is checked when the print media 75 does not obstruct the sensor 200. In other words, the status signal is checked when the emitted light passes between two successive pages. The controller 65 knows the locations of the leading and trailing edges of each page and initiates the checking of the status signal when a page is not obstructing the sensing area.

It will be appreciated that a plurality of sensors 200 may be positioned at various locations in the post transfer area of the printer 10. With this configuration, when any one of the sensors 200 indicates an undesirable amount of toner dust, the warning signal 230 is generated. In another embodiment, the light emitting diode 205 and the photosensor 210 are positioned facing each other such that the reflector 225 is not required. In another embodiment, the sensor 200 includes an array of photodiodes and photodetectors. It will also be appreciated that other types of sensors can be used to detect/sense the accumulation of toner dust such as other optical sensing components that are excited by light and/or, may include a pressure sensor that senses or otherwise measures the weight of accumulated toner dust.

With the present invention, a gauge for toner accumulation in a printer 10 is provided that can warn against potential print quality defects and printer reliability problems. Data from the sensor 200 is used to display information to advise a user to perform a cleaning of the printer 10 to avoid potential defects and failures.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

We claim:

1. An apparatus for detecting toner particles in an electrophotographic imaging device comprising:

a toner sensor positioned within the electrophotographic imaging device to detect uncontained toner wherein the toner sensor is positioned in a post transfer area within the electrophotographic imaging device; and a controller, coupled to the toner sensor, that generates a warning signal when the uncontained toner reaches a predetermined level.

2. The apparatus as set forth in claim 1 wherein the toner sensor includes a status signal representing an amount of uncontained toner detected and, the controller including logic to selectively check the status signal of the toner sensor.

3. The apparatus as set forth in claim 1 wherein the toner sensor includes at least one diode that emits light and at least one light sensor positioned to detect the light from the at least one diode.

4. The apparatus as set forth in claim 3 wherein the at least one light sensor includes a status signal representing an amount of light detected, the predetermined level is reached when the uncontained toner reduces an amount of light detected by the at least one light sensor to the predetermined level.

5. The apparatus as set forth in claim 3 further including a reflective surface positioned to reflect the light from the at least one diode towards the at least one light sensor.

6. The apparatus as set forth in claim 5 wherein the reflective surface is positioned on a toner containing wall.

7. The apparatus as set forth in claim 1 wherein the toner sensor is positioned adjacent and subsequent to a toner transfer point where toner is transferred to a print media in the electrophotographic imaging device.

8. The apparatus as set forth in claim 1 wherein the electrophotographic imaging device includes:

a photoconductor drum for carrying toner representing data to be printed;

a transfer roller for transferring the toner from the photoconductor drum to a print media; and a fuser that fuses the toner to the print media after the transferring, the toner sensor being positioned between the photoconductor drum and the fuser.

9. A method of detecting toner dust in an electrophotographic imaging device, the method comprising the steps of:

moving one or more print media along a printing path within the electrophotographic imaging device;

transferring toner to the print media at a transfer point along the printing path;

detecting an accumulation of toner dust subsequent to the transfer point; and generating a warning signal when the accumulation of toner dust meets a predetermined condition.

10. The method of detecting toner dust as set forth in claim 9 wherein the detecting is selectively initiated during a non-printing mode being at least one of before and after the moving and transferring steps.

11. The method of detecting toner dust as set forth in claim 9 wherein the detecting is selectively initiated during the moving step and between two successive print media.

12. The method of detecting toner dust as set forth in claim 9 wherein the detecting includes emitting light at a first point and detecting the light at a second point, where if an intensity of the light detected reaches a threshold value, the warning signal is generated.

13. The method of detecting toner dust as set forth in claim 9 wherein the detecting includes detecting the accumulation of toner dust at a plurality of locations subsequent to the transfer point.

14. The method of detecting toner dust as set forth in claim 9 wherein generating the warning signal includes generating at least one of an audible signal, a visible signal and a text message.

15. An electrophotographic imaging device comprising:

a photoconductor drum for forming a latent electrostatic image representing print data;

a developing roller for transferring toner to the photoconductor drum in accordance with the latent electrostatic image;

a transfer roller that transfers, at a transfer area, the toner from the photoconductor drum to a print media;

a fuser for fusing the toner to the print media;

a toner dust sensor positioned in a post transfer area between the transfer roller and the fuser, the toner dust sensor detecting an accumulation of toner dust; and a controller, coupled to the toner dust sensor, for generating a warning signal when the accumulation of toner dust reaches a threshold value.

16. The electrophotographic imaging device as set forth in claim 15 where the toner dust sensor includes at least one light emitting diode and at least one photodetector positioned to detect light emitted from the at least one light emitting diode.

17. The electrophotographic imaging device as set forth in claim 16 wherein the at least one light emitting diode is positioned to directly transmit light towards the at least one photodetector.

18. The electrophotographic imaging device as set forth in claim 15 wherein the warning signal includes one of a visual signal, an audible signal and a text message.

19. The electrophotographic imaging device as set forth in claim 15 wherein the toner dust sensor generates a status signal indicative of the accumulation of toner dust, and the controller includes logic to compare the status signal to the threshold value and determine a rate of accumulation.

20. The electrophotographic imaging device as set forth in claim 15 wherein the toner dust sensor includes a sensor means for detecting uncontained toner.

* * * * *